United States Patent [19]

Sheahan

[11] 4,386,489

[45] Jun. 7, 1983

[54] METAL TRUSS FOR USE IN REINFORCED CONCRETE SLABS

[76] Inventor: James J. Sheahan, 6400 S. East Ave., Hodgkins, Ill. 60525

[21] Appl. No.: 224,396

[22] Filed: Jan. 12, 1981

[51] Int. Cl.[3] ..... E04C 3/02

[52] U.S. Cl. ..... 52/694

[58] Field of Search ..... 52/694, 339, 329, 327, 52/651, 652

[56] References Cited

U.S. PATENT DOCUMENTS 3,930,349 1/1976 Wellershaus ..... 52/694

FOREIGN PATENT DOCUMENTS 212962 3/1957 Australia ..... 52/694

523538 10/1953 Belgium ..... 52/329

824848 12/1951 Fed. Rep. of Germany ..... 52/339

1442994 5/1966 France ..... 52/327

*Primary Examiner*—James L. Ridgill, Jr.

[57] ABSTRACT

A truss made for use in the manufacturing of reinforced concrete slabs including a web portion so formed that it provides a series of V-shaped risers joined together by a center segment which lie along a common axis, with each alternate riser inclined downwardly and outwardly to opposite sides of the center segment. The V-shaped risers will have connected thereto horizontally disposed bottom chords and a top chord that extends through each of the center segments connecting the V-shaped risers together thus forming a reinforced truss.

1 Claim, 4 Drawing Figures

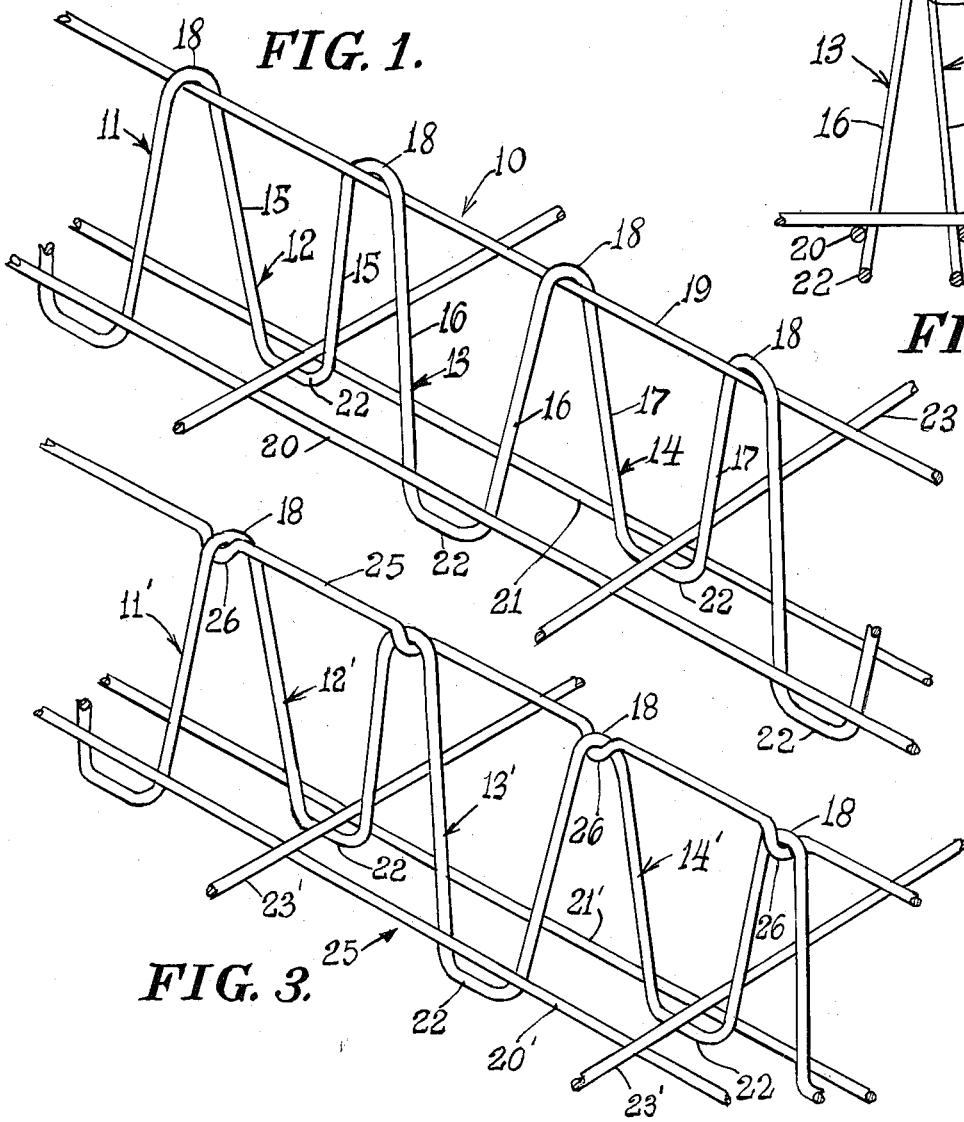
FIG. 1.
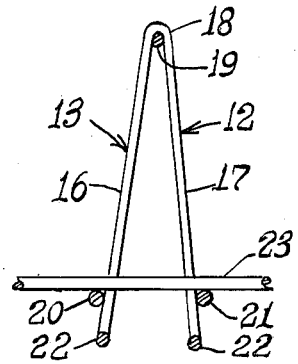
FIG. 2.
FIG. 3.
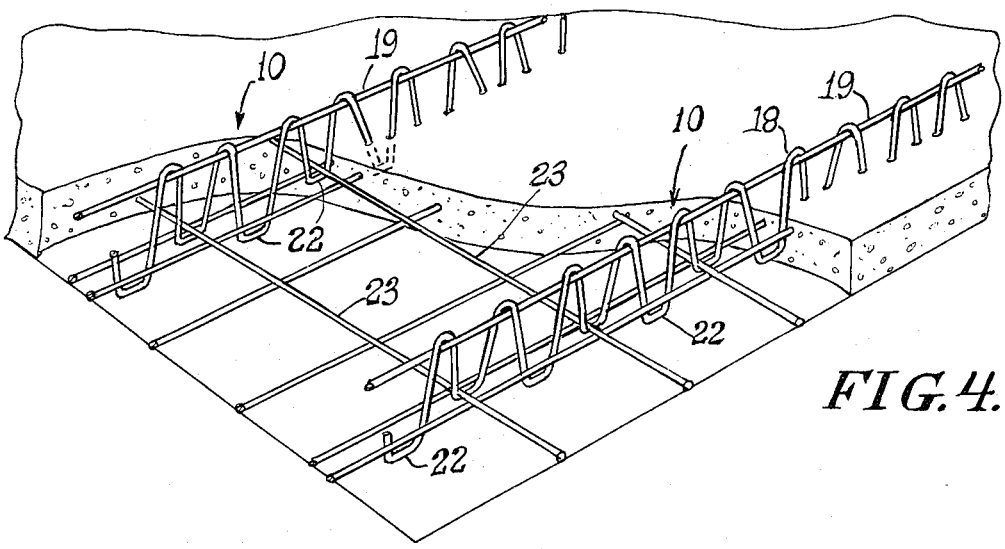
FIG. 4.

METAL TRUSS FOR USE IN REINFORCED CONCRETE SLABS

SUMMARY OF THE INVENTION

The invention relates to the forming of a truss for use in reinforced concrete slabs utilized in the construction of concrete floors, roofs, and the like.

The truss of this invention is formed from a continuous strand of wire bent in a sinuous path which provides a series of substantially V-shaped risers of uniform length. Each of the V-shaped risers is connected by a center segment. Each alternate substantially V-shaped riser is disposed to opposite sides of a vertical plane that extends through the center segment. Each of the V-shaped risers extends from the center segment in an inclined downwardly and outwardly direction so as to form an inverted V structure when viewed from end to end through a horizontal plane.

A pair of parallelly extending horizontally disposed bottom chords are connected to the risers to either side of the center segment. A top chord extends horizontally and parallel to the bottom chords beneath the center segment connecting each of the alternately disposed V-shaped risers.

The bottom chords are utilized to chair steel reinforcing rods that extend at right angles to the longitudinal length of the truss. The chaired steel reinforcing members when positioned on the bottom chords will be raised inwardly of the bottom surface of the concrete slab a predetermined distance. The top chord may be used as a control surface for screeding the top concrete which is placed upon the slab so as to form a finished monolithic deck.

GENERAL DESCRIPTION OF THE DRAWINGS

The invention will be best understood by reference to the accompanying drawings which illustrate the preferred embodiment of the invention by which the stated objects are achieved and in which:

FIG. 1 is a fragmentary perspective view of the metal truss of this invention;

FIG. 2 is a fragmentary side elevational view of the truss of FIG. 1;

FIG. 3 is a fragmentary perspective view of a modified truss of this invention, and;

FIG. 4 is a fragmentary detailed view of a truss of this invention embodied in a concrete slab.

GENERAL DESCRIPTION OF THE INVENTION

As shown in FIG. 1, there is the metal trusses 10 of this invention which includes a single strand of wire 11 formed through a sinuous path to provide substantially V-shaped web portions 12, 13 and 14. These V-shaped web portions 12, 13 and 14 provide riser members 15, 16 and 17.

As shown in FIG. 1, a riser member 15 of the web portion 12 is connected to a riser 16 of the web portion 13 by a center segment 18. Likewise, one riser 16 of the web portion 13 is connected to a riser 17 of the web portion 14 by a corresponding center segment 18. This arrangement is carried out throughout the longitudinal length of the truss which may be of any desired length depending upon the length requirements of the reinforced concrete slab. Extending beneath the center segments 18 is a horizontally disposed top chord 19. As noted in FIG. 2, the top chord 19 functions as a horizontal axis to either side of which are disposed alternating web portions 12 and 13, as shown.

Cooperating with each riser of each of the V-shaped web portions are bottom chords 20 and 21. By this arrangement, it is noted that the bottom chord 20 is connected to the riser 16 of web portions 13 and will be connected to every other web portion of the truss just as bottom chord 21 is shown connected to the risers 15 and 17 of the V-shaped web portions 12 and 14.

By this arrangement, there is provided a rigid truss which has extreme resistance to deflections either in the horizontal or vertical planes when it is employed in conjunction with a concrete slab.

The bottom chords 20 and 21 provide a chair for reinforcing rods 23. These rods 23 extend at right angles to the truss 10 and are elevated with respect to the base 22 of each web portion by the chords 20 and 21. By placing the rods 23 on the chords 20 and 21 and between the risers of the web portion, their placement is uniform within the truss.

FIG. 4 shows a pair of trusses 10 with the base 22 of each web portion in position to be encapsulated by concrete. When the slab is formed, only the top chord 19 together with a portion of the risers of each of the web portions are exposed. The top chord then provides a surface indicator that can be used as a control for screeding of the finished top concrete as it is poured on the slab 10 to form a finished monolithic deck.

FIG. 3 discloses a modified form of a truss 24 which incorporates all of the components of the truss 10 which are identified by like reference numerals primed, with the exception of the top chord 25.

In the modified truss 24 the top chord 25 is periodically formed with an indentation 26 that, in turn, will receive the center segment 18' connecting together each of the web portions 12', 13' and 14'. By this arrangement, there is provided a continuous flush control line for properly screeding of the top concrete to be poured on the slab.

The truss is configured so that it extends from the bottom surface of the slab to a controlled top surface provided by the top chord 19 thereby allowing the truss to be used as a screed for the concrete pour which allows the overall thickness of the slab to be controlled very accurately. It also acts as a reference point for the placement and positioning of top steel on the complete emplaced slab. The top chord 19 may be plastic coated with the coating acting as a rust preventative. The bottom of the web portions may also be plastic coated to prevent rust spots appearing on the slab underside.

While I have illustrated and described the preferred form of construction for carrying my invention into effect, this is capable of variation and modification without departing from the spirit of the invention. I, therefore, do not wish to be limited to the precise details of construction as set forth, but desire to avail myself of such variations and modifications as come within the scope of the appended claims.

Having thus described my invention what I claim as new and desire to protect by Letters Patent is:

1. A truss used in the construction of reinforced concrete slabs comprising:

(a) an elongated single strand of wire bent throughout its length to provide a series of web portions, (b) each of said web portions having a pair of riser members with each riser extending in opposite downwardly and outwardly direction with respect to each other, (c) a curved apex connecting the upper ends of said oppositely directed risers together to form an elongated inverted V-shaped truss, (d) a substantial flat base connecting oppositely directed risers of juxtapositioned web portions together in a coplanar relation to form a continuous sinuous truss with said flat bases providing elevated chairs for reinforcing rod members extending at right angles to said truss and adapted to connect a series of trusses in spaced parallel relation, (e) a top chord extending longitudinally through said apexes so that each riser of each pair of risers are disposed and extend to opposite sides thereof, and (f) a pair of bottom chords extending longitudinally of said series of web portions in an elevated plane with respect to said base connections between certain of said risers and outbound of said risers connecting each series of risers to either side of said top chord together into an integral truss.

* * * * *